United States Patent [19]

Schmidt

[11] Patent Number: 5,027,568

[45] **Date of Patent: * Jul. 2, 1991**

[54] METHOD OF CONSOLIDATING CRACKS IN A STRUCTURE

[75] Inventor: Arno P. O. Schmidt, Abstatt, Fed. Rep. of Germany

[73] Assignee: Hilti Aktiengsellschaft

[ * ] Notice: The portion of the term of this patent subsequent to Mar. 6, 2007 has been disclaimed.

[21] Appl. No.: 408,128

[22] Filed: Sep. 15, 1989

Related U.S. Application Data

[62] Division of Ser. No. 222,275, Jul. 21, 1988, abandoned.

[30] Foreign Application Priority Data

Jul. 24, 1987 [DE] Fed. Rep. of Germany ..... 3724559

[51] Int. Cl.[5] ..... E04H 14/00

[52] U.S. Cl. ..... 52/173 R

[56] References Cited

U.S. PATENT DOCUMENTS 4,044,512 8/1977 Fischer et al. ..... 52/127

4,382,720 5/1983 Vonach ..... 52/173 R

*Primary Examiner*—David A. Scherbel

*Assistant Examiner*—Creighton Smith

*Attorney, Agent, or Firm*—Toren, McGeady & Associates

[57] ABSTRACT

A method of injecting a hardenable mass into cracks in a structure includes drilling a borehole into the structure traversing the cracks. Inserting a tubular member into the borehole with the tubular member having an outside diameter smaller than the diameter of the borehole. Filling the gap between the borehole surface and the tubular member with a hardenable mass forming a seal of the gap at the opening into the borehole. After the seal has hardened, injecting a hardenable mass into the tubular member so that it flows into the borehole and enters into the cracks in the structure.

3 Claims, 1 Drawing Sheet

METHOD OF CONSOLIDATING CRACKS IN A STRUCTURE

This is a division of application Ser. No. 07/222,275, filed July 21, 1988, now abandoned.

BACKGROUND OF THE INVENTION

The present invention is directed to a method of injecting a hardenable mass into cracks or capillaries of a structure. It is known to seal off cracks and capillaries in a structure, such as a concrete structure, by forcing or injecting a water-repelling hardenable mass at high pressures about 150 to 200 bar into the cracks and/or capillaries.

In DE-OS 31 17 286, a so-called packer is disclosed for the above purpose and has a tubularly-shaped filling stub which is fixed in a fluid-tight manner in a borehole formed in a structure. A rubber sleeve encircling the filling stub fixes the stub in the borehole and the sleeve is radially clamped in the borehole and undergoes an axial shortening.

In this type of attachment, a cumbersome manipulation by the user is involved. Moreover, excessive pressure and partial spalling of the surface of the structure can occur during the clamping operation in the outer region of the borehole. Furthermore, such packers have a complicated construction and, as a result, are expensive.

A simpler device as compared to the packer is disclosed in DE-OS 32 03 871. The packing device in this patent publication has essentially a conically-shaped outside configuration so that a wedge-type fastening in the borehole is achieved for the purpose of sealing using the packing device. Experience has shown that the retaining values developed are mostly insufficient for resisting the counterpressure occurring when the mass is injected, with the result that the packing device is released and the sealing action is lost.

From DE-OS 22 26 169 concerning securing anchor ties in the ground, it is known to fasten an essentially tubularshaped anchor in the outer region of the borehole by introducing cement and water into the gap located between the anchor and the borehole wall.

After the cement mortar have set, which can require a long period of time, additional cement mortar is introduced into the deeper region of the borehole for effecting the desired anchorage.

While the present invention deals with the repair or rehabilitation of a structure such as in the method disclosed in DE-OS 22 26 169, a comparison with previously-mentioned restoration of cracked or porous structures is not possible. In this described method,.the anchor tie, inserted into the borehole, passes through different layers of the ground and forms an element for holding the layers together. Accordingly, cement mortar is introduced into a gap between the anchor tie and the inside surface of the borehole for establishing a connection between the individual ground layers and the anchor tie. Since only the borehole, that is, the gap between the borehole surface and the anchor tie is to be filled with cement mortar, high pressures are not required for injecting the mortar, as would be needed in the previously-mentioned methods of repairing cracked structures. The mortar introduced into the outer region of the borehole for fixation purposes does not have to meet any higher requirements, particularly as far as compression strength is concerned. In addition, in the case of anchor ties, a long period of time is required before the completion of the anchorage. accordingly, a long setting time for the cement mortar used for filling the borehole as well as for fastening the anchor tie is acceptable.

SUMMARY OF THE INVENTION

Therefore, the primary object of the present invention is to provide a method of injecting flowable masses into cracks in a structure which is characterized by the simplicity of the steps and the apparatus involved, so that a dependable seal is provided for injecting the flowable mass and sealing the cracks.

In accordance with the present invention. initially a borehole traversing the cracks in the structure is formed and a tubular member is inserted into the borehole with the tubular member having a smaller diameter than the borehole diameter. Next, the opening into the gap between the borehole surface and the tubular member is sealed by injecting a hardenable sealing mass. After the sealing mass has hardened, a flowable hardenable mass is injected through the tubular member into the structure.

In accordance with the method of the present invention, the tubular member is surrounded by the sealing mass at least in the outer region of the borehole, so that after the mass is hardened, the tubular member is fixed and sealed in a tight manner. A dispensing device normally used for injecting such flowable masses is employed for filling the sealing mass into the annular gap between the borehole surface and the tubular member. Such dispensing devices include dispensing nozzles permitting a sufficiently accurate supply of the sealing mass into the annular gap. The distribution of the sealing mass into the annular gap is adequately supplied, if the dispensing nozzle is applied only at one point around the annular gap. To facilitate the distribution of the sealing mass, however, the dispensing nozzle can be positioned at several different locations around the annular gap.

With regard to the quantity of the sealing mass to be used for fastening and sealing a single tubular member, the quantity can be left to the experience of the person carrying out the method. As a rule, it is sufficient if only the outer region of the tubular member is enclosed by the sealing mass.

If the sealing mass flows into a deeper region of the borehole, this does not interfere with the subsequent injection of a flowable mass, because the pressures employed in injecting such flowable masses are so high that any interfering residues of the sealing mass are removed or bypassed.

Since several injection operations are performed as a rule in the region of the cracks, it is preferable to fasten and seal several tubular members consecutively by means of the sealing mass. Since the annular gap between the tubular member and the borehole surface has a width of about 3 mm, experience has shown that approximately 6 to 8 tubular members can be fastened and sealed in boreholes of about 13 mm in diameter with sealing mass packages presently in use.

It is advantageous if the sealing mass has a relatively high viscosity, so that when used with tubular members in vertical walls, the sealing mass does not flow out of the gap. Accordingly, both physically and chemically solidifying sealing masses can be used in the method of the present invention. While a physically solidified sealing mass, such as a fusion adhesive, requires a relatively large amount of apparatus for the filling step, chemically solidifying masses, such as two-component hardenable masses are much more suitable with regard to the apparatus required. Accordingly, such two component hardenable flowable masses are preferred for the present invention.

Two-component hardenable flowable masses can be prepared from epoxy, polyisocyanate or polymerizable unsaturated acrylic or especially polyester compounds. These flowable masses proposed as sealing means are characterized by a sufficiently high viscosity which corresponds approximately to ten times the viscosity of the injectable mass used, and they have a favorable hardenable period of only a few minutes.

The apparatus required for carrying out the method of the present invention is distinguished by forming the filling member as a tubular member with an injection nipple. Such a filling member is very economical as far as fabrication is concerned, and also as well as the amount of material involved. On one hand, the tubular member is an available and inexpensive material, while on the other hand the injection nipple is a commerically available mass-producted product. Such an injection nipple is provided with a generally known check valve. A variety of materials for forming the tubular member can be used, such as metals and plastics materials. The only preparation for the tubular member is cutting it to the desired length and forming a connection for the injection nipple, preferably in the form of an inside thread.

Preferably, the over-all length of the tubular member and the injection nipple is greater than the axial length or depth of the borehole. With such a length, at least the injection nipple, but preferably a portion of the tubular member, projects from the opening into the borehole extending outwardly from the surface of the structure to receive the injected mass. Such an arrangement greatly facilitates the injection of the annular gap, by permitting the dispensing member to be guided up to the part of the filling member projecting outwardly from the structure. Accordingly, it is assured that the inlet opening of the nipple is not covered by the sealing mass.

Experience has shown that no special means, such as stubs or the like, are necessary for positioning the filling member. There is no difficulty involved for a worker to hold the filling member while .the sealing mass is being introduced. Preferably, the tubular element of the filling member is positioned so that it does not quite reach the base of the borehole.

Depending on the particular conditions involved, the part of the filling member projecting outwardly from the structure can remain. If, however, the projecting part causes any interference, it is possible to sever the projecting part or to remove the entire filling member by pulling it out. The projecting part of the filling member can be removed by a cutting member or by breaking it off. To facilitate breaking off the projecting part, notches or similar means can be formed in the tubular member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
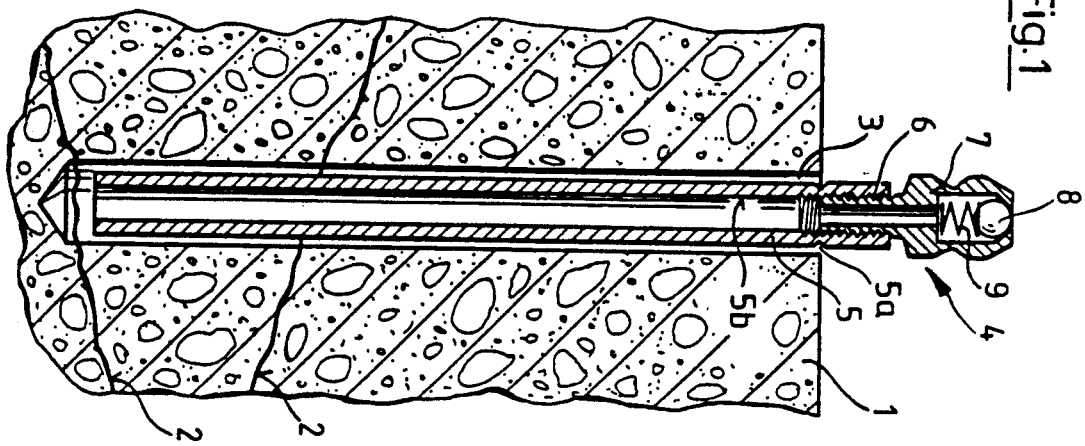
FIG. 1 is a axially extending sectional view illustrating the insertion of a filling member into a borehole.

In the drawing, a concrete structure 1 is shown with a number of cracks 2 passing through it. Boreholes 3 are drilled into the structure 1 with the boreholes traversing or passing through the cracks. A filling member 4 is inserted into a borehole 3 so that it has a first or inner end adjacent the base of the borehole and a second or outer end projecting outwardly from the surface of the structure containing the borehole. The filling member 4 includes an axially elongated tubular members located within and projecting outwardly from the borehole with an inside thread 6 in the end of the tubular member projecting outwardly from the structure. An injection nipple 7 is connected to the thread 6 in the tubular member. The nipple 7 projects in axial alignment with and outwardly from the tubular member 5. The first end of the tubular member is spaced closely from the base of the borehole while its outer or second end projects outwardly from the surface of the concrete structure. The tubular member 5 has a circumferential notch 5*a* located at the surface of the concrete structure 1. Notch 5*a* serves as an indicator for locating the tubular member within the borehole and also acts as a rated breaking location. Injection nipple 7 includes a ball 8 and a compression spring 9 biasing the ball 8 into a closed position and forming a known check valve. As can be seen in FIG. 1, the outside diameter of the tubular member 5 is smaller than the diameter of the surface of the borehole so that an annular gap is provided between the borehole surface and the outside of the tubular member.

Figure 2:
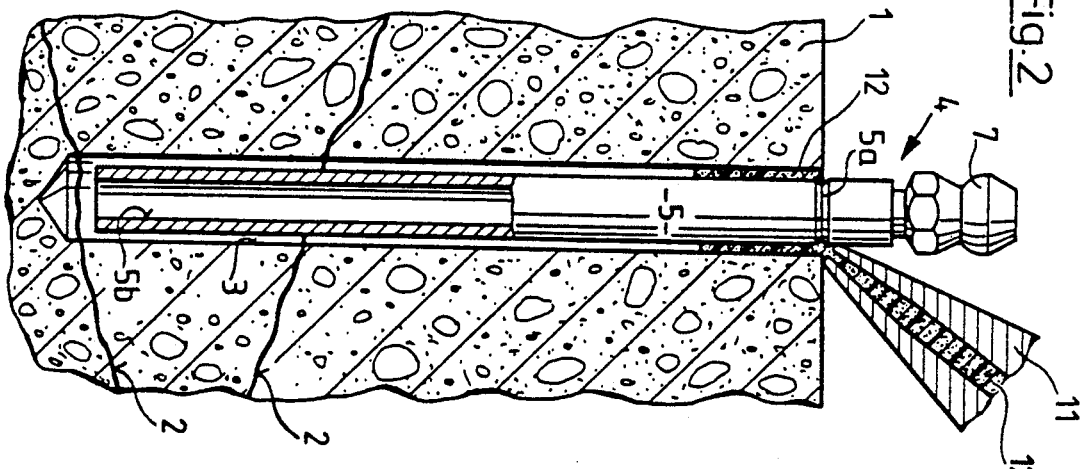
FIG. 2 is a view similar to FIG. 1, showing the introduction of the sealing mass into the borehole.

After the filling member 4 is positioned as shown in FIG. 1, a sealing mass 12, note FIG. 2, is introduced by a dispensing device 11 into the annular gap between the tubular member 5 and the borehole surface. The sealing mass is introduced into the axial region extending inwardly from the opening to the borehole, as shown in FIG. 2. The sealing mass hardens within a few minutes and secures the filling member 4 in the structure in a sealed manner.

Figure 3:
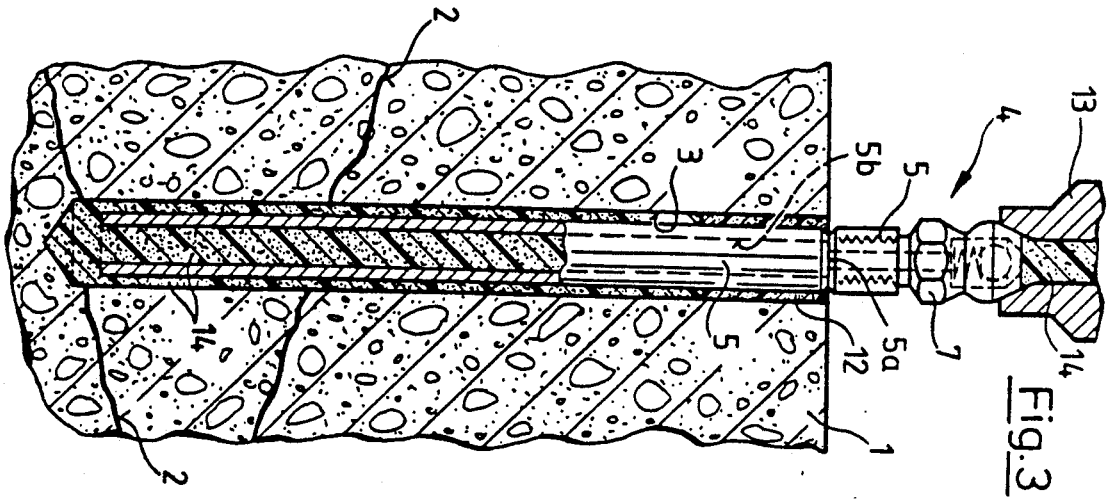
FIG. 3 is a view similar to FIGS. 1 and 2 displaying the flowable mass injected through the filling member into the borehole.

The next step of the method is displayed in FIG. 3 where an injection mass 14 is forced through the tubular member 5 into the base of the borehole so that it flows in the annular gap around the tubular member toward the sealing mass 12. The mass 14 is injected by a dispenser 13 positioned on the injection nipple 7. As the injection mass 14 flows through the annular gap, it enters into the cracks in the structure and due to its adhesive effect provides a stabilization of the structure 1.

After the injection mass 14 has hardened, the part of the filling member projecting outwardly from the surface of the structure 1 can be removed at the rated breaking point defined by the notch 5*a*, so that the injection nozzle 7 and the axially extending section of the tubular member 5 extending outwardly from the opening into the borehole is removed and the remainder of the tubular member 5 is secured within the borehole.

While specific embodiments of the invention have been shown and described in detail to illustrate the application of the inventive principles, it will be understood that the invention may be embodied otherwise without departing from such principles.

I claim:

1. Apparatus for injecting a flowable mass into cracks and the like in a structure containing boreholes traversing the cracks and the like with the boreholes having an opening, comprising a filling member comprising an axially elongated tubular member having an open first end arranged to be inserted into the borehole and a second end arranged to be located outwardly from the borehole, and an injection nipple secured to the second end of the tubular member and projecting outwardly therefrom, said tubular member having an outside diameter extending from the opening to the borehole toward the first end smaller than the diameter of the borehole, said tubular member has a thread extending axially from the second end thereof, said injection nipple has a threaded section connected to the thread in said tubular member, said tubular member has an axially extending outside surface, and a circumferentially extending annular notch in said outside surface, said annular notch located adjacent the second end of said tubular member and arranged to be located at the opening to the borehole so that said tubular member can be broken off at the annular notch after the flowable mass has been injected into the tubular member.

2. Apparatus, as set forth in claim 1, wherein said thread has an end spaced from the second end of said tubular member, and said annular notch is located in the region of said thread adjacent the end thereof spaced from the second end.

3. Apparatus, as set forth in claim 2, wherein said tubular member has a length from said annular notch to the first end thereof less than the depth of the borehole into which the tubular member is inserted, said tubular member has an outside diameter extending from the first end to the second end thereof sufficiently smaller than the borehole so that an annular gap is formed therebetween for receiving an injected sealing mass.

* * * * *

UNITED STATES PATENT AND TRADEMARK OFFICE

CERTIFICATE OF CORRECTION

PATENT NO. : 5,027,568
DATED : July 2, 1991
INVENTOR(s) : Arno P. O. Schmidt

It is certified that error appears in the above-identified patent and that said Letters Patent is hereby corrected as shown below:

On the Title page, item [73], should read:

Assignee: Hilti Aktiengesellschaft,
Fürstentum Liechtenstein

Signed and Sealed this

Fifteenth Day of December, 1992

*Attest:*

DOUGLAS B. COMER

*Attesting Officer*

*Acting Commissioner of Patents and Trademarks*